US005503535A

United States Patent [19]

Thoma et al.

[11] Patent Number: 5,503,535

[45] Date of Patent: Apr. 2, 1996

[54] HYDRAULIC RADIAL PISTON MACHINES

[75] Inventors: Christian H. Thoma; George D. M. Arnold; Arthur A. Blair, all of Jersey, Great Britain

[73] Assignee: Unipat AG, Glarus, Switzerland

[21] Appl. No.: 343,462

[22] PCT Filed: May 21, 1993

[86] PCT No.: PCT/GB93/01051

§ 371 Date: Nov. 28, 1994

§ 102(e) Date: Nov. 28, 1994

[87] PCT Pub. No.: WO93/24734

PCT Pub. Date: Dec. 9, 1993

[30] Foreign Application Priority Data

| | | | |
|---|---|---|---|
| May 27, 1992 | [GB] | United Kingdom | 9211212 |
| Jun. 2, 1992 | [GB] | United Kingdom | 9211614 |
| Jul. 24, 1992 | [GB] | United Kingdom | 9215825 |
| Nov. 17, 1992 | [GB] | United Kingdom | 9224046 |

[51] Int. Cl.[6] ..... F04B 1/06

[52] U.S. Cl. ..... 417/219; 417/273; 91/491

[58] Field of Search ..... 417/219, 220, 417/273; 91/497, 491

[56] References Cited

U.S. PATENT DOCUMENTS

| | | | |
|---|---|---|---|
| 1,398,788 | 11/1921 | Mayer | 91/494 |
| 1,721,225 | 7/1929 | Levering | 91/482 |
| 2,227,631 | 1/1941 | Carter | 60/491 |
| 2,741,993 | 4/1956 | Orshansky, Jr. | 91/486 |
| 2,827,859 | 3/1958 | Crane | 91/485 |
| 3,006,283 | 10/1961 | Haar | 91/483 |
| 3,200,762 | 8/1965 | Thoma | 91/501 |
| 3,750,533 | 8/1973 | Thoma | 91/498 |
| 3,756,749 | 9/1973 | Aldinger | 417/220 |
| 3,955,477 | 5/1976 | Rutz | 91/497 |
| 4,056,042 | 11/1977 | Rutz et al. | 91/497 |
| 4,686,829 | 8/1987 | Thoma et al. | 60/464 |
| 4,920,859 | 5/1990 | Smart et al. | 91/497 |
| 4,979,583 | 12/1990 | Thoma et al. | 180/62 |
| 5,059,099 | 10/1991 | Cyphers | 417/311 |
| 5,078,659 | 1/1992 | Von Kaler et al. | 475/78 |
| 5,228,290 | 7/1993 | Speggiorin | 60/482 |
| 5,228,366 | 7/1993 | Thoma et al. | 74/606 R |

FOREIGN PATENT DOCUMENTS

| | | | |
|---|---|---|---|
| 219455 | 7/1981 | German Dem. Rep. | 91/497 |
| 4402470 | 8/1994 | Germany | 417/273 |
| 153941 | 11/1920 | United Kingdom | 417/219 |
| WO83/04284 | 12/1983 | WIPO . | |
| WO91/19902 | 12/1991 | WIPO . | |

*Primary Examiner*—Richard A. Bertsch
*Assistant Examiner*—Peter G. Korytnyk
*Attorney, Agent, or Firm*—Young & Thompson

[57] ABSTRACT

A hydrostatic piston machine having a housing comprising two shells of a part-cylindrical form, the shells connectable together along a parting-plane in which the central axes of the drive-shaft and cylinder-barrel lie. Each housing element is provided with a number of semi-circular formations and recesses which form pockets or apertures when the housing shells are connected together to provide support surfaces for the working elements of the machine. A cylinder-barrel mounted within a chamber formed between the shells and is provided with a number of cylinders each containing a piston. Fluid-passageways are provided in the housing to receive and supply fluid to the pistons of the machine.

20 Claims, 4 Drawing Sheets

HYDRAULIC RADIAL PISTON MACHINES

FIELD OF THE INVENTION

This invention relates to positive displacement rotary radial piston hydraulic machines, and is particularly directed at a more economical and efficient form of housing structure for such machines. In the radial piston type of hydraulic machine, a cylinder-barrel is mounted for rotation on a ported pintle-valve, and is provided with a number of generally radial cylinders. Each cylinder contains a piston and each piston engages a slipper which contacts a surrounding annular track-ring. The arcuate-ports in the pintle-valve are connected to fluid inlet and outlet passageways in the housing and thus rotary movement of the cylinder-barrel is accompanied by radial displacement of the pistons and corresponding displacement of fluid through these passageways. The control-system acts in determining the degree of eccentricity required between the track-ring and pintle-valve, in order to supply the desired rate of fluid to a hydraulic circuit.

DESCRIPTION OF THE PRIOR ART

Fixed-displacement gear-pumps currently account for about 80% of all hydrostatic pump sales, with the more versatile, but more expensive variable-displacement type of piston pump taking most of the balance.

Despite widespread agreement that variable-displacement hydraulic systems provide significant efficiency advantages over fixed-displacement ones, no existing variable-displacement piston pump design is capable of competing with fixed-displacement pumps on cost.

In part, this is due to the many quite complex internal components required in a variable-displacement piston pump, such as the pistons and the cylinder barrel. Nowadays with modern CNC production machinery and using inexpensive processes such as sintered powder-metallurgy, these components are no-longer significantly more expensive to produce than the intermeshing spur gears and associated floating bearings of a gear pump.

However, the bulk of the differences in cost is largely due to the complex and high-precision housing structures which have been required throughout the 100 year history of variable-displacement piston pumps. Typically, the housing structure comprises two or more broadly cylindrical or circular elements.

U.S. Pat. No. 3,750,533 shows an example of such a housing for a piston machine, and where each housing element is provided with a central aperture in order to support the drive-shaft and pintle-valve respectively. However, the multitude of machining operations required to produce all the necessary features in the housing amounts towards a significant proportion of the total manufacturing cost of the pump.

Alternatively, the housing structure for a piston machine may comprise four members as shown in U.S. Pat. No. 3,200,762, where two of such members are of part cylindrical form which engage with two circular housing members to achieve the complete housing structure for the machine. However, this form of more elaborate housing structure still requires a multitude of machining operations in order to be effective.

By contrast with such piston devices as mentioned above, the housing structure for a gear pump is comparatively simple requiring much less machining.

Therefore, what is required is an inexpensive housing structure for variable-displacement piston pumps which is as simple and efficient to produce as the typical housing structure presently used for gear pumps.

SUMMARY OF THE INVENTION

From one aspect the invention consists in a housing for a radial piston hydrostatic machine having a drive-shaft, comprising two shells connectable together along a parting plane in which the rotating axis of the drive-shaft lies and wherein the interior of each said shell is formed with a number of generally semi-circular formations and/or recesses, respective pairs of said formations and/or recesses form apertures or pockets to receive and/or support internal elements of said hydrostatic machine.

It is one feature of the invention to support the drive-shaft in a bearing or bearings which are held between the two shells. Rotation of the cylinder-barrel causes turbulence inside the internal chamber of the machine and results in fluid being displaced along lubrication-grooves to fed these bearings with low-pressure oil.

It is a further feature of the invention to support the pintle-valve between the shells, and where deformable seal-rings are used to provide a leak-free interface between the fluid-ducts in the pintle-valve and their associated passageways in each respective the shell.

It is believed that these and other subsequent improvements described in the specification below are likely to result in the lowest cost, variable-displacement piston pump yet devised, well able to compete with the gear-pump on cost while providing better performance and thus likely to capture an appreciable portion of that very substantial market.

BRIEF DESCRIPTION OF THE DRAWINGS

The invention may be performed in various ways and one specific embodiment is now described by way of example with reference to the accompanying drawings, in which.

DESCRIPTION OF THE INVENTION

Description of the Housing Shells

Figure 1:
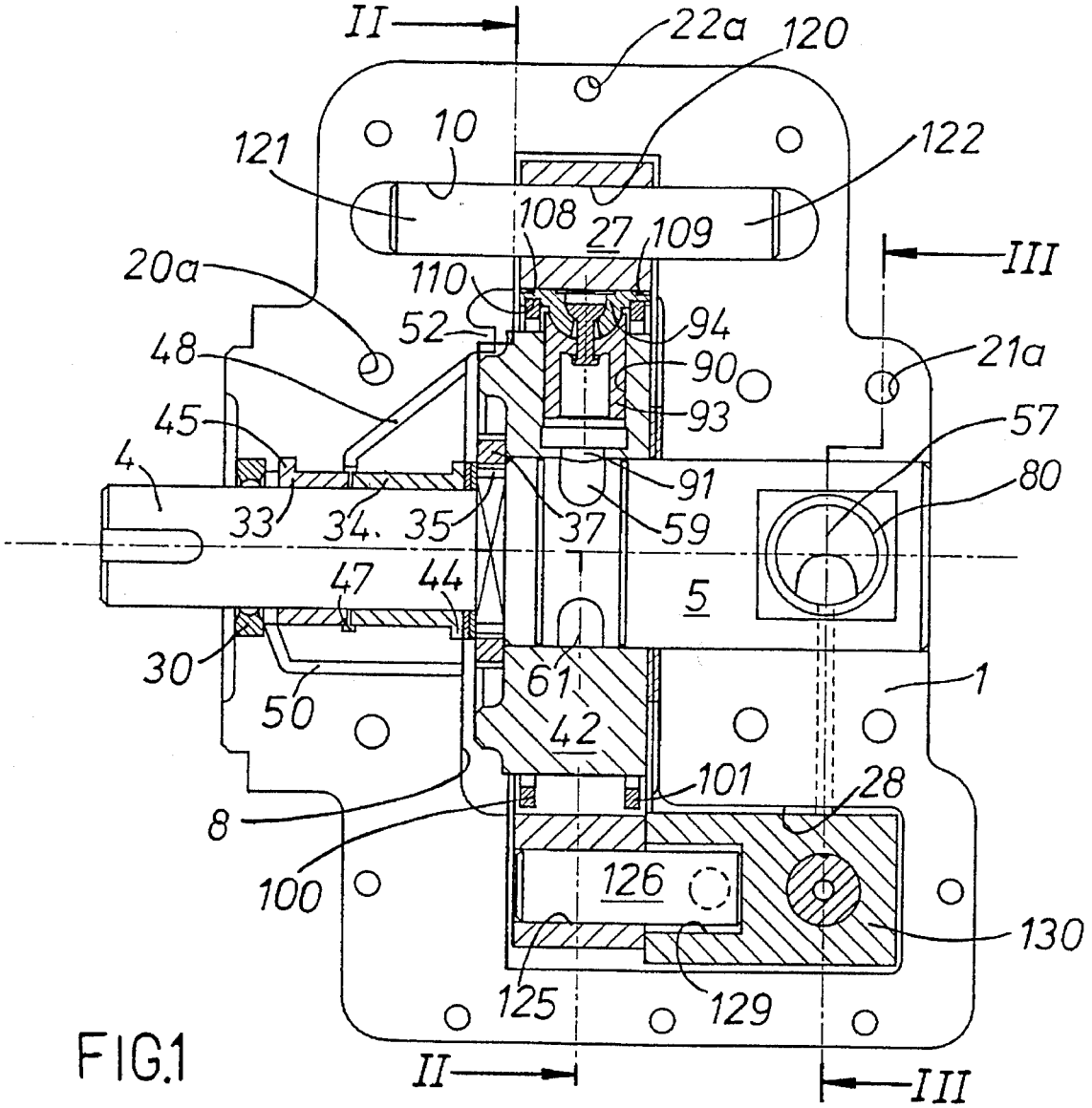
FIG. 1 is a longitudinal view of a hydrostatic piston machine according to the invention.
Figure 2:
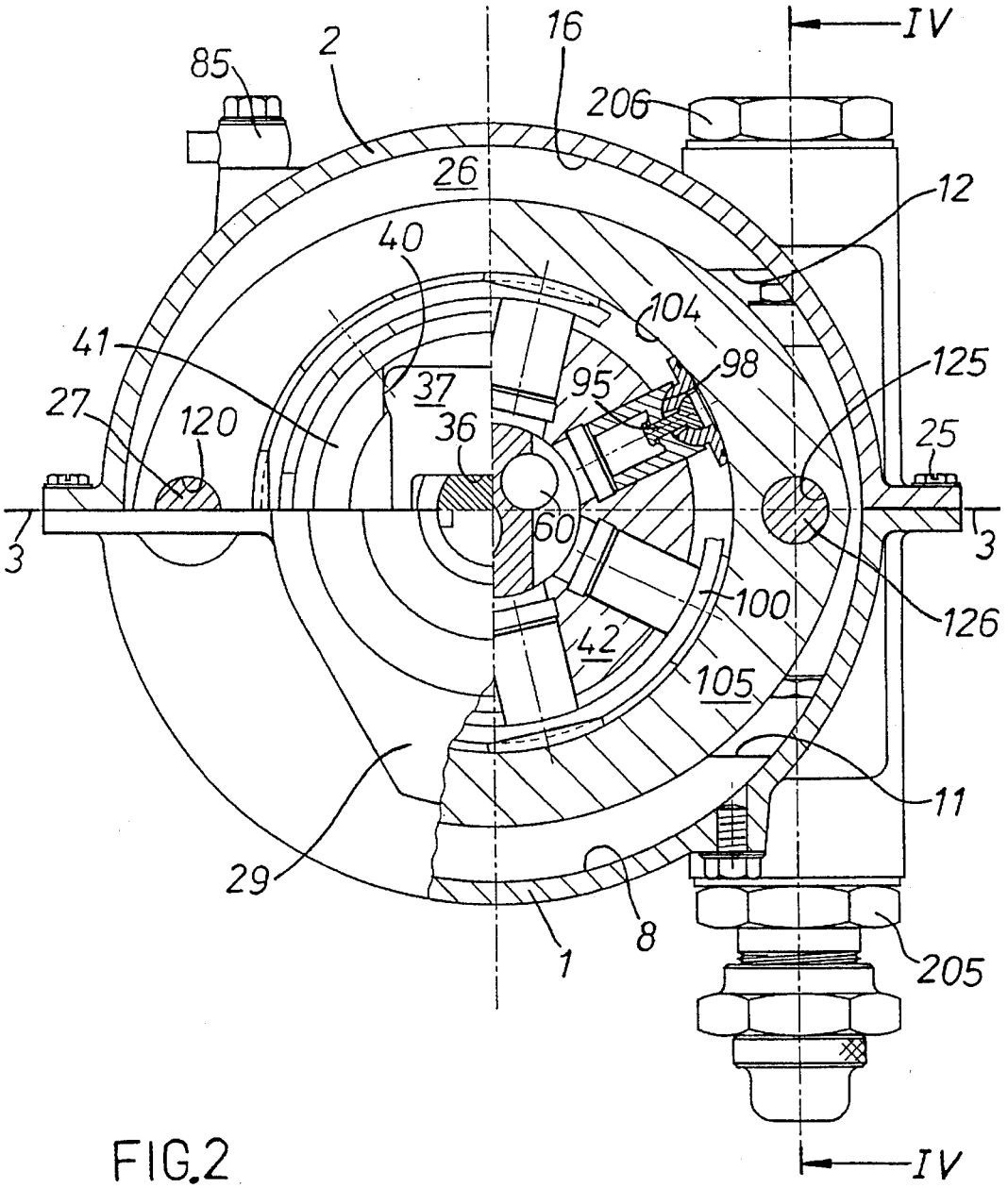
FIG. 2 is a cross sectional view along line 11—11 of FIG. 1.

The machine comprises an outer housing structure which surrounds the internal working piston elements. Preferably, the housing structure is formed by means of two shells 1, 2 of part-cylindrical form which interface with each other on a common parting plane 3 along which the axes of the drive-shaft 4 and pintle-valve 5 lie.

Preferably the two shells 1, 2 are fabricated from the aluminium die-casting process to include all necessary detail. As a result, the number of expensive and high-precision metal-cutting operations required with fabrication of earlier housing types, may now be substantially reduced or completely eliminated. As a die-casting, the shells may be provided with a multitude of heat dissipating fins and stiffening ribs to provide a strong and stiff housing structure.

Shell 1 is provided with one large semi-circular recess 8 and a number of smaller semi-circular recesses such as shown at 9, 11. Similarly shell 2 is also provided with an equal number of such recesses, as shown for example, recesses 16, 12, 17.

Attachment points are provided in both shells, for instance, blind-holes 20*a*, 21*a*, 22*a* in shell 1 that correspond with through-holes 20*b*, 21*b* in shell 2.

Once all the working elements of the machine have been positioned into shell 1, anaerobic-sealant is applied, by a process such as "silk-screening", to the upper exposed surface of shell 1 as shown in FIG. 1 along which lies the parting plane 3. Shell 2 is then lowered onto shell 1 along parting plane 3, and a number of thread-forming machine-screws 25 being used to attach shells 1, 2 together. By way of example, machine-screw 25 is inserted through the exterior opening of the through-hole 21*a* in shell 2, and protrudes through to engage with the associated blind-hole 21*b* provided in shell 1. As machine-screw 25 is rotated, it forms a thread along the axis of the blind holes 21*b*. Once all the machine-screws has been tightened down, the shells 1, 2 are locked together as at unitary housing component.

Thus respective recesses in each shell combine to form complete apertures, for instance, recesses 8, 16 combining as an aperture which forms the internal chamber 26 of the machine. Likewise, recesses 9, 17 combine to form an aperture which surrounds the cylindrical pintle-valve 5. After the anaerobic sealant has cured, the resulting internal-chamber 26 is sealed from the outer surrounding environment.

Further recesses are formed in each respective shell 1, 2, and are used to support some of the other working elements of the machine, for instance, recesses 10 in shell 1 combines with a corresponding recesses (not visible) in shell 2 creating an aperture that provides the support surface for the pivot-pin 27. Similarly, recesses 11, 12 combined together to provide an aperture acting as an internal sub-chamber 28 for the various elements that comprise the displacement control-system mechanism for the machine.

Each shell 1, 2 is provided with one arm of a flange member which forms the mounting surface to which the machine is attached to a support bracket. As shown, the flange member 29 can be arranged to be perpendicular to the parting plane, although alternatively, such arms may also be disposed parallel to the parting plane. In this case, each shell contains half of each respective arm including a shaped-depression, and the two halves of each arm combine when the shells are placed together.

Description of the Internal Elements

A shaft-seal 30 is positioned between shells 1, 2 to surround the drive-shaft 4 in order to prevent any fluid from escaping from the internal-chamber 26.

Respective shells 1, 2 combine to form the cylindrical support surface for the bearings 33, 34 carrying the drive-shaft 4.

The end of the drive-shaft 4 is provided with a tongue 35 which fits into a corresponding slot 36 in the "oldham" type misalignment coupling 37. The coupling 37 fits into a slot 40 provided on the end face 41 of the cylinder-barrel 42, and acts to compensate for any inaccuracy that may exists between the respective axes of the drive-shaft 4 and pintle-valve 5.

Although the type of bearing here used to support the drive-shaft 4 is the simple journal type, the recesses provided in the shells 1, 2 can be modified in shape to accept other type of bearings, such as ball-bearings, if desired.

However the porous type of powder-metal journal bearings 33, 34 illustrated here are provided with an integral flange 44 at one end. In the case of the inner journal 34, the flange 44 acts as a thrust bearing for the machine. A small 45 step is provided as shown for journal 33 in order to prevent rotation. A small gap 47 is provided between the adjacent ends of each journal 33, 34 so to accept fluid displaced by the rotating cylinder-barrel 42 via lubrication supply-groove 48.

A vane 52 is provided in the shells 1, 2 so that the fluid in internal chamber 26 which is caused to be displaced by the action of the rotating cylinder-barrel 42, may be directed by vane 52 into lubrication supply groove 48. As a result, the fluid feeding the journals 33, 34 is slightly pressurized.

The fluid lubricates and cools both journals 33, 34 before returning to the internal chamber 26. In the case of the outer journal 33, the fluid also keeps shaft-seal 30 lubricated before returning via lubrication return groove 50 to internal-chamber 26.

The pintle-valve 5 is provided with two ducts 56, 57, duct 56 being connected by internal low-pressure axial-passage 58 to arcuate-slot 59, whereas duct 57 is connected by internal high-pressure axial-passage 60 to arcuate-slot 61. Plugs (not shown) are used to close off the end of each respective axial-passage 58, 60.

Figure 3:
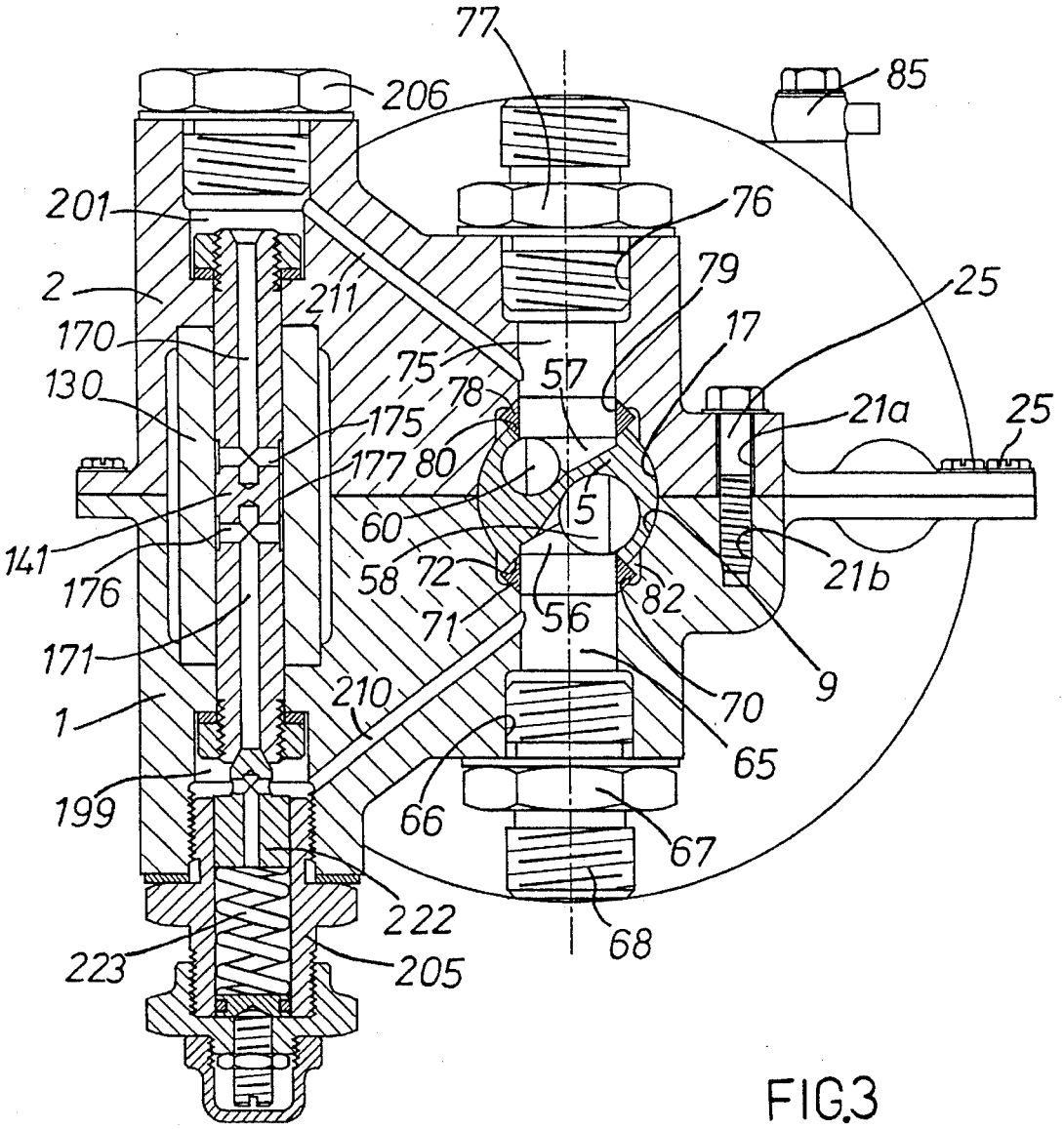
FIG. 3 is a cross sectional view along line III—III of FIG. 1.
Figure 4:
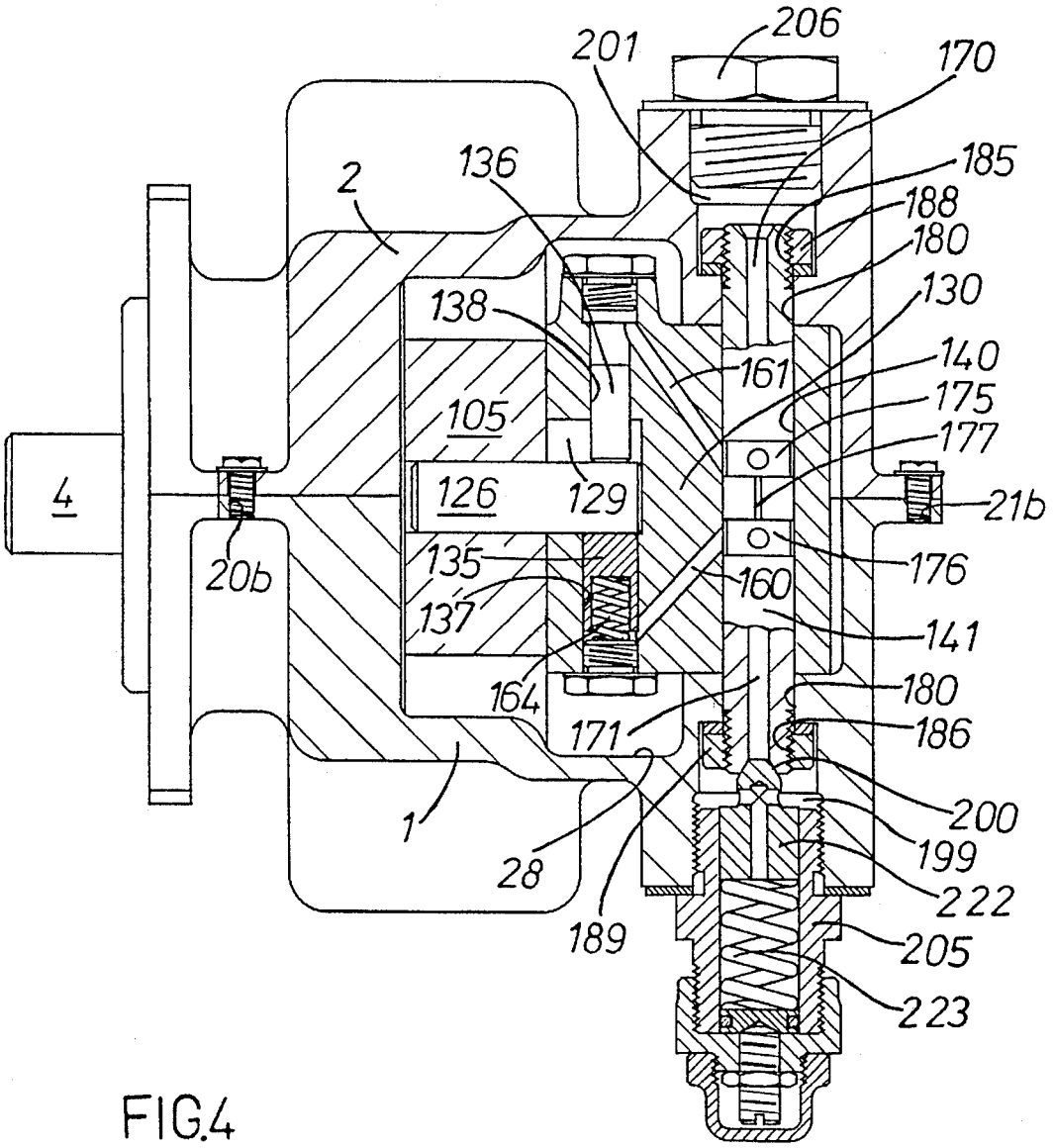
FIG. 4 is a longitudinal view along line IV—IV of FIG. 2.

As shown in FIG. 3, shell 1 is cast to include a fluid low-pressure passageway 65 which is exposed on the exterior surface of the shell 1. The longitudinal axis of passageway 65 is set perpendicular to the parting plane 3 between the shells 1, 2, and is threaded 66 for part of its length in order that a suitable hollow coupling-sleeve 67 can be attached to the exterior of shell 1. The hollow coupling-sleeve 67 is shown to include a male-thread at it outer end 68 in order that suitable external fluid-conduits may be used to connect the machine to a hydraulic circuit.

Passageway 65 is extended to open on the interior surface of shell at angled-seat 70. Angled-seat 70 engages against a complementary angled-face on the deformable seal-ring 71, and a further angled-face provided on the opposite side of deformable seal-ring 71 engages with complementary angled-seat 72 provided around duct 56 in pintle-valve 5.

Similarly shell 2 is formed with a passageway 75 and threaded portion 76 for the location of hollow coupling-sleeve 77. Deformable ring-seal 78 is engaged between angled-seat 79 in shell 2 and the seat 80 surrounding duct 57 in pintle-vale 5.

When the two shells 1, 2 have been placed together during assembly, the deformable seal-rings 71, 78 begin to be deformed as soon as the machine-screws 25 cause the shells 1, 2 to be clamped together, such that the required fluid tight seal is obtained between the opening of each of the passageways 65, 75 and their associated ducts 56, 57.

However, in the event that a small amount of pressurized hydraulic fluid is able to seep past either deformable seal-rings 71, 78, it becomes de-pressurized immediately as enters annular cavity 82 (surrounding the seal-ring). Annular cavity 82 is connected via a drain-groove (not shown) to internal chamber 26 which always remains at low-pressure. As a result, any pressurized fluid that seeps past deformable seal-rings 71, 78 is prevented from causing shells 1, 2 to be forced apart.

Further apertures may also included in each shell, and depending on which is at the highest point in the machine installation, leakage fluid collected and contained within internal chamber can be released to a reservoir tank via pipe 85. Alternatively, the machine may also be provided with check-valves in order that inside internal chamber to be directly re-admitted to either ducts in the pintle-valve depending of course, on which particular is at suction pressure at that particular moment.

The cylinder-barrel 42 is supported for rotation on the pintle-valve 5 and includes a number of cylinders 90 each connected through a respective "necked" port 91 to allow fluid distribution between each of the cylinders 90 and the respective pair of arcuate-slots 59, 61 formed on the pintle-valve 5.

Each cylinder 90 contains a piston 93 which is attached to a respective slipper 94 by means of a rivet 95. Rivet 95 is a relatively loose fit in the piston 93 so to allow fluid from the cylinder 90 to reach the face of the slipper 94, and thereby creating a hydrostatic fluid support bearing. Pistons 93 and slippers 94 mate together on a part-spherical socket 98 to allow articulation of the slipper 94 on the piston 93.

Guidance-rings 100, 101 are provided and serve to keep the slippers 94 in close proximity with the annular surface 104 of the track-ring 105. This feature combined with the centrifugal force on the piston/slipper serves to enhance the suction characteristics of this type of hydrostatic machine.

The guidance-rings 100, 101 are attached to the slippers 94 in such a way that they cannot contact against the adjacent housing walls of the machine. In order to achieve this desirable and necessary feature, each slipper 94 is provided with two shoulders 108, 109 and were on one shoulder 108, a capturing-groove 110 is provided. Each slipper 94 is engaged by its capturing-groove 110 to one of the guidance-rings 100, 101, such that once all the slippers 94 are assembled, some engaging one ring 101, others engaging the other 101, the combined effect is that the guidance-rings 100, 101 become trapped in the capturing-grooves 110, and retained in place and prevented from sliding or falling off from the shoulders 108, 109 of the slippers 94.

The track-ring 105 is provided with a hole 120 into which pivot-pin 27 is located, pivot-pin 27 being extended at either end 121, 122 to protrude from hole 120 in order that the protruding ends 121, 122 can be directly supported in the pockets 10 provided in shells 1, 2. Thereby the track-ring 105 is supported within the machine and allowed limited articulated movement about the pivot-pin 27.

A further hole 125 is provided in the track-ring 105 into which a control-pin 126 is located. The control-pin 126 protrudes from the track-ring 105 to project into the cavity 129 provided in the manifold-block 130, where it is engaged on opposite sides by actuating-rams 135 and 136. The rams 135, 136 are contained within their respective cylinders 137, 138 in a manifold-block 130, and a further bore 140 is included which contains the captive-conduit 141. Cylinders 137, 138 being of unequal sizes are arranged to communicate with bore 140 by means of respective holes 160, 161.

Axial-holes 170, 171 are machined into each end of the captive-conduit 141, and where each hole 170, 171 is connected to a circumferential-groove 175, 176. The throttle-groove 177 positioned between the circumferential-grooves 175, 776 thereby acts as the only means of communication between axial-holes 170, 171. Each circumferential-groove 175, 176 is connected by an associated drilled hole 161, 160 acting as the feed-lines to their respective cylinder 136, 135.

The captive-conduit 141 is extended past the side faces of the manifold-block 130 to project through a clearance hole 180 in respective passageway 199, 201. The captive-conduit 141 is threaded at each end 185, 186 to accept retaining nuts 188, 189, these nuts are only attached to the ends 185, 186 of captive-conduit 141 after the machine has been fully assembled.

Passageway 199, 201 are enclosed by means of a respective threaded-plug 205, 206, and passageway 199 is connected by drilled hole 210 to the suction-passage 65 of the machine, whereas passageway 201 is connected by drilled hole 211 to the pressure-passage 75 of the machine.

One end of the captive-conduit 141 is provided with a seat 200 that surrounds the opening of axial-hole 171, and a poppet-valve 222 is pressed against seat 200 by means of a coil-spring 223.

When poppet-valve 222 "lifts" from its seat 200 under the action of pressure in axial-hole 171, fluid is released from axial-hole 171 and allowed to enter passageway 199 from where it passes through drilled-hole 210 to the low-pressure passageway 65 of the machine. Threaded-plug 205 can be adjusted to vary the tension of coil-spring 223 in order that the pressure setting (point of poppet-valve 22 lift) for the machine can be changed.

The throttle-groove 177 produces a large pressure-drop between the cylinders 137, 138 as soon as poppet-valve 222 "lifts". As a result, the throttle-groove 177 prevents an undue amount of pressurised fluid in passageway 75 from being released to the low-pressure passageway 65 of the machine which would otherwise be very wasteful of energy.

Therefore the volumetric output of the machine is determined by the level of pressure in the external hydraulic circuit, and the set degree of tension in coil-spring 223 causing it to load poppet-valve 222 against seat 200.

However, when the level of pressure becomes sufficiently great to "lift" poppet-valve 222 by compression of coil-spring 223, the pressure acting behind the large ram 135 decreases almost immediately whereas the pressure acting behind the small ram 136 remains at approximately the same level as in the circuit. When this occurs, small ram 136 effectively controls the eccentric position of the track-ring 105 relative to the pintle-valve 5 and as a result, the force of the small ram 136 acting on the control-pin 126 of the track-ring 105 causes the eccentricity between the track-ring 105 and pintle-valve 5 to reduce, thereby effecting a change in the volumetric output of the machine.

Operation of the Machine

The operation of the machine is as follows: Rotation of the drive-shaft 4 causes the cylinder-barrel, 42 to rotate. If track-ring 105 is set in an eccentric relationship to the pintle-valve 5, outward sliding movement of the pistons 93 in their respective cylinders 90 is obtained, such that fluid from some external source, such as a hydraulic reservoir, is drawn in via the low-pressure passageway 65 and directed by arcuate-slot 59 and into the interior of cylinder 90 via "necked" port 91. When the piston 93 returns inwards in its cylinder 90, the fluid is expelled from the interior of the cylinder 90 via "necked" port 91 into the opposite arcuate-slot 61 from where it is directed through high-pressure passageway 75 to service any hydraulic circuit, such as a hydraulic motor. During periods when the poppet-valve 222 is seated, oil pressure from the pressure-side passageway of the machine 75 is received by both rams 135, 136 acting against the control-pin 126. As the large ram 135 (downstream of the throttle 177) has effectively twice the area of the small ram 136, the resultant force from the large ram 135 on the control-pin 126 is sufficient to keep the track-ring 105 in eccentric relationship to the pintle-valve 5. However, when the "cracking" pressure is reached, and the poppet-valve 222 is lifted from its seat 200, the pressure of the oil behind the large ram 135 falls, and the eccentricity of the track-ring 105 to the pintle-valve 5 reduces.

While this invention has been described as having a preferred design, it can be further modified within the teachings of this disclosure. This application is therefore intended to cover any variation, uses, or adaptations of the invention following its general principles. This application is also intended to cover departures from the present disclosure as come within known or customary practice in the art to which this invention pertains and falls within the limits of the appended claims.

We claim:

1. In a radial piston hydrostatic machine, a housing having a projecting power transmission drive-shaft for the input of mechanical power which said machine converts into hydraulic fluid movement comprising: two shells connectable together along a parting-plane in which the rotating axis of said drive-shaft lies, said shells defining a number of generally semi-circular recesses to form pockets or apertures to receive internal elements of said hydrostatic machine and together defining a chamber extending transversely to said parting-plane for receiving a cylinder-barrel in a location for rotation by said drive-shaft, said cylinder-barrel drivingly connected to said drive-shaft to rotate at equal speed, the adjacent portions of said shells on one side of said location defining a mounting for said drive-shaft and the adjacent portions of said shells on the other side of said location defining one or more fluid-passageways for fluid distribution of the moving hydraulic fluid.

2. In a radial piston hydrostatic machine according to claim 1 wherein at least one of said fluid-passageways is arranged to have its longitudinal axis perpendicular to said parting-plane.

3. In a radial piston hydrostatic machine according to claim 2 wherein said at least one of said fluid-passageways contains fluid at low-pressure drawn-in from an external source.

4. In a radial piston hydrostatic machine according to claim 3 wherein the longitudinal axis of said at least one of said fluid-passageways is arranged to intersect the said rotating axis of said drive-shaft.

5. In a radial piston hydrostatic machine according to claim 2 wherein said at least one of said fluid-passageways is extended along its longitudinal axis to an exterior surface on said housing to provide an external-opening.

6. In a radial piston hydrostatic machine according to claim 2 wherein said at least one of said fluid-passageways is positioned at the interior surface of said housing to provide an internal-opening on one of said recesses, said internal-opening arranged to join with a corresponding duct provided on a pintle-valve, and where said internal-opening and said duct are arranged to join together at an interface non-coincident with said parting-plane.

7. In a radial piston hydrostatic machine according to claim 1 wherein each said shell is manufactured as an aluminium alloy pressure die-casting and is provided with a plurality of attachment points, the longitudinal axes of said attachment points being arranged parallel with said at least one of said fluid-passageways and perpendicular to said drive-shaft, and whereby screws fitted into said attachment points act in locking said shells together in their assembled condition.

8. In a radial piston hydrostatic machine according to claim 1 wherein a pintle-valve is mounted in the said adjacent portions of said shells on the other side of said location to be in co-axial relationship with said drive-shaft, said pintle-valve protruding into said chamber to support said cylinder-barrel, said pintle-valve and said drive-shaft protruding towards one another without touching, and where said pintle-valve is provided with both an internal low-pressure axial passage to communicate with one of said fluid-passageways in said housing, and a second internal high-pressure axial passage to communicate with any other said fluid-passageways in said housing.

9. In a radial piston hydrostatic machine according to claim 8 wherein said pintle-valve is formed with a pair of arcuate-slots, said cylinder-barrel provided with generally radial cylinder-bores and rotating on said pintle-valve, a piston disposed in each said cylinder-bore and moveable therein, said cylinder-bores communicating with respective ports within the internal surface of said cylinder-barrel and arranged to co-operate successively with said arcuate-slots in said pintle-valve as said cylinder-barrel rotates, and where said pistons are operatively connected to a surrounding moveable annular track-ring, said moveable track-ring is operatively connected by displacement means, the action of said displacement means causing the movement of said track-ring in a direction generally transverse to said parting-plane.

10. In a radial piston hydrostatic machine according to claim 1 wherein each said shell is provided with an internal flange member to form a external mounting surface for said machine, and where said external mounting surface is located on the same said adjacent portions having the mounting for said drive-shaft.

11. In a variable-displacement piston pump, a housing having a projecting power transmission drive-shaft for the input of mechanical power which said piston pump converts into hydraulic fluid movement comprising: two shells connectable together along a parting-plane in which the rotating axis of said drive-shaft lies, said shells defining a number of generally semi-circular recesses to form pockets or apertures to receive internal elements of said piston pump and together defining a chamber extending transversely to said parting-plane for receiving a cylinder-barrel in a location for rotation by said drive-shaft, said cylinder-barrel drivingly connected to said drive-shaft to rotate at equal speed, the adjacent portions of said shells on one side of said location defining a mounting for said drive-shaft and the adjacent portions of said shells on the other side of said location defining one or more fluid-passageways for fluid distribution of the moving hydraulic fluid.

12. In a variable-displacement piston pump according to claim 11 wherein at least one of said fluid-passageways is arranged to have its longitudinal axis perpendicular to said parting-plane.

13. In a variable-displacement piston pump according to claim 12 wherein said at least one of said fluid-passageways is extended along its longitudinal axis to an exterior surface on said housing to provide an external-opening and contains fluid at low-pressure drawn-in from an external source.

14. In a variable-displacement piston pump according to claim 13 wherein the longitudinal axis of said at least one of said fluid-passageways is arranged to intersect the said rotating axis of said drive-shaft.

15. In a variable-displacement piston pump according to claim 12 wherein each said shell is manufactured as an aluminium alloy pressure die-casting and is provided with a plurality of attachment points, the longitudinal axes of said attachment points being arranged parallel with said at least one of said fluid-passageways and perpendicular to said drive-shaft, and whereby screws fitted into said attachment points act in locking said shells together in their assembled condition.

16. In a variable-displacement piston pump according to claim 11 wherein each said shell is provided with an integral flange member to form a external mounting surface for said piston pump.

17. In a variable-displacement piston pump according to claim 11 wherein said piston pump includes a pintle-valve mounted in the said adjacent portions of said shells on the other side of said location to be in co-axial relationship with said drive-shaft, said pintle-valve protruding into said chamber to support said cylinder-barrel, said pinkie-valve and said drive-shaft protruding towards one another without touching, said pintle-valve being provided with both an internal low-pressure axial passage to communicate with one of said fluid-passageway in said housing, and a second internal high-pressure axial passage to communicate with any other said fluid-passageways in said housing, a track-ring radially outwardly disposed of said cylinder-barrel, said track-ring being eccentrically moveable from the rotating axis of said drive-shaft.

18. In a hydrostatic piston machine, a housing having a projecting power transmission drive-shaft for the output of mechanical power which said piston machine converts from hydraulic fluid movement comprising: two shells connectable together along a parting-plane in which the rotating axis of said drive-shaft lies, said shells defining a number of generally semi-circular recesses to form pockets or apertures to receive internal elements of said hydrostatic machine and together defining a chamber extending transversely to said parting-plane for receiving a cylinder-barrel in a location for rotation by said drive-shaft, said cylinder-barrel drivingly connected to said drive-shaft to rotate at equal speed, the adjacent portions of said shells on one side of said location defining a mounting for said drive-shaft and the adjacent portions of said shells on the other side of said location defining one or more fluid-passageways for fluid distribution of the moving hydraulic fluid.

19. In a hydrostatic piston machine according to claim 18 wherein at least one of said fluid-passageways is arranged to have its longitudinal axis perpendicular to said parting-plane.

20. In a hydrostatic piston machine according to claim 19 wherein each said shell is manufactured as an aluminium alloy pressure die-casting and is provided with a plurality of attachment points, the longitudinal axes of said attachment points being arranged parallel with said at least one of said fluid-passageways and perpendicular to said drive-shaft, and whereby screws fitted into said attachment points act in locking said shells together in their assembled condition.

* * * * *

UNITED STATES PATENT AND TRADEMARK OFFICE

CERTIFICATE OF CORRECTION

PATENT NO. : 5,503,535

DATED : April 2, 1996

INVENTOR(S) : Christian Helmut THOMA et al.

It is certified that error appears in the above-indentified patent and that said Letters Patent is hereby corrected as shown below:

Column 1, line 1 and
Item [54], change "HYDRAULIC RADIAL" to --HYDROSTATIC--.
Column 7:
Claim 7, line 2, change "claim 1" to --claim 2--.
Column 8:
Claim 10, line 2, change "internal" to --integral--.
Column 9:
Claim 17, line 6, change "pinkie-valve" to --pintle-valve--.

Signed and Sealed this

Thirtieth Day of July, 1996

Bruce Lehman

*Attest:*

BRUCE LEHMAN

*Attesting Officer*

*Commissioner of Patents and Trademarks*